US005509640A

United States Patent [19]

Vesper

[11] Patent Number: 5,509,640

[45] Date of Patent: Apr. 23, 1996

[54] POST-AND-PANEL BUILDING WALLS

[76] Inventor: Dale E. Vesper, 5654 Oceanic Rd., Holiday, Fla. 34690

[21] Appl. No.: 179,848

[22] Filed: Jan. 11, 1994

Related U.S. Application Data

[63] Continuation-in-part of Ser. No. 14,640, Feb. 8, 1993, Pat. No. 5,421,558, and a continuation-in-part of Ser. No. 912, 895, Jul. 13, 1992, and a continuation-in-part of Ser. No. 835,241, Feb. 12, 1992, said Ser. No. 835,241, is a continuation-in-part of Ser. No. 455,061, Dec. 22, 1989, Pat. No. 5,129,628, which is a continuation-in-part of Ser. No. 178, 261, Apr. 6, 1988, Pat. No. 5,184,808.

[51] Int. Cl.[6] ..... E04H 17/16

[52] U.S. Cl. ..... 256/31; 256/73; 256/24; 52/309.7; 52/586.1

[58] Field of Search ..... 256/24, 31, 73, 256/19; 405/267; 52/586.1, 586.2, 761, 220.3, 220.2, 290, 781, 169.1, 169.4, 169.2, 169.3, 238, 239, 309.16, 601, 309.7

[56] References Cited

U.S. PATENT DOCUMENTS

| | | | |
|---|---|---|---|
| 2,039,601 | 5/1936 | London | 52/78 X |
| 2,107,418 | 2/1938 | Keller | 52/586.2 |
| 2,269,018 | 1/1942 | Guignon, Jr. | 52/761 X |
| 2,741,342 | 4/1956 | Etten | 52/761 X |
| 2,742,777 | 4/1956 | Corneil et al. | 52/761 |
| 2,883,852 | 4/1959 | Midby | 52/761 X |
| 3,160,249 | 12/1964 | Pavlecka | 52/586.2 |
| 3,228,158 | 1/1966 | Russell | 52/761 X |
| 3,503,165 | 3/1970 | Hardt | 52/220.2 X |
| 3,918,223 | 11/1975 | Carlsson | 52/220.2 |
| 5,007,222 | 4/1991 | Raymond | 52/586.1 |
| 5,421,558 | 6/1995 | Vesper | 256/31 |

*Primary Examiner*—Anthony Knight
*Assistant Examiner*—Harry C. Kim
*Attorney, Agent, or Firm*—Charles A. McClure

[57] ABSTRACT

Reinforced fence and building wall construction having upright tubular posts supporting lightweight foam wall panels extending from post to post. The vertical side edges of the panels are recessed to accommodate enough of the post circumferential extent to conceal the posts from exterior view. The panels have reinforcing members, preferably both upper and lower, extending horizontally between and to the panel vertical side edges. Each end of a reinforcing member is similarly recessed and has an adjacent lip, preferably formed from the end of the reinforcing member before its recessing, fitting closely about the post. During installation of such a wall the lips of the reinforcing members are fastened to their respective posts.

16 Claims, 3 Drawing Sheets

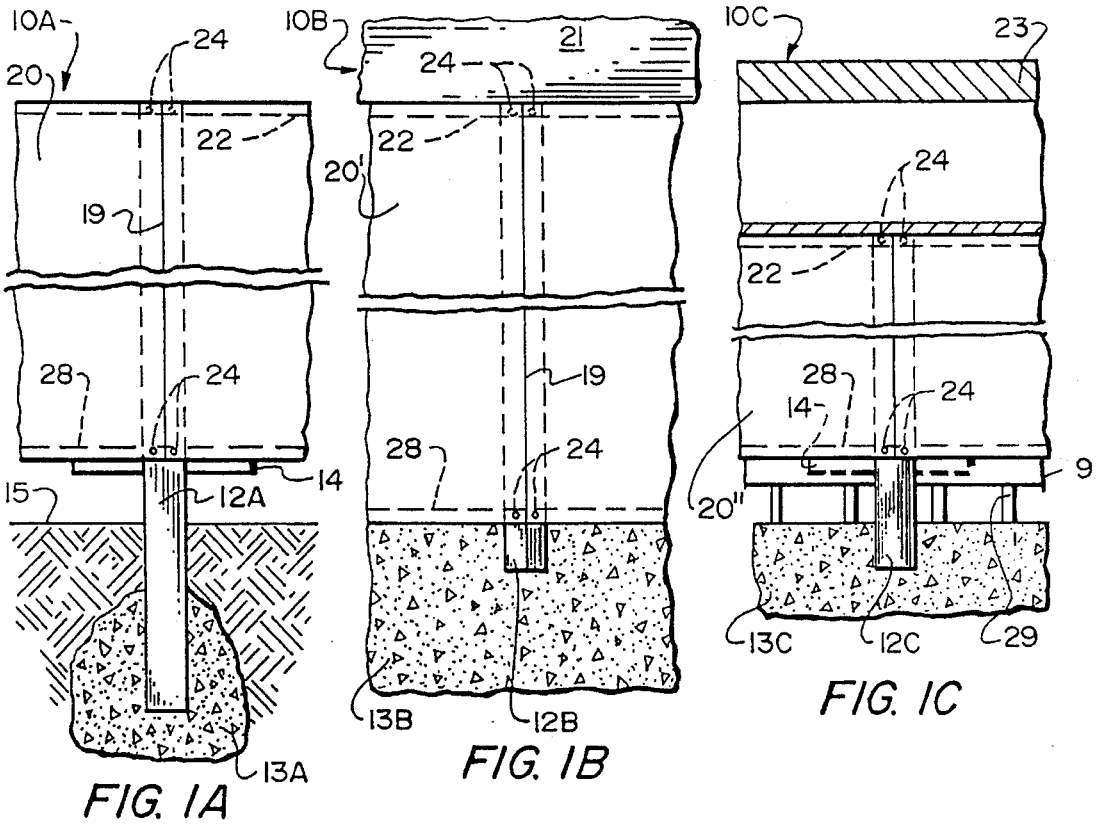
FIG. 1A
FIG. 1B
FIG. 1C
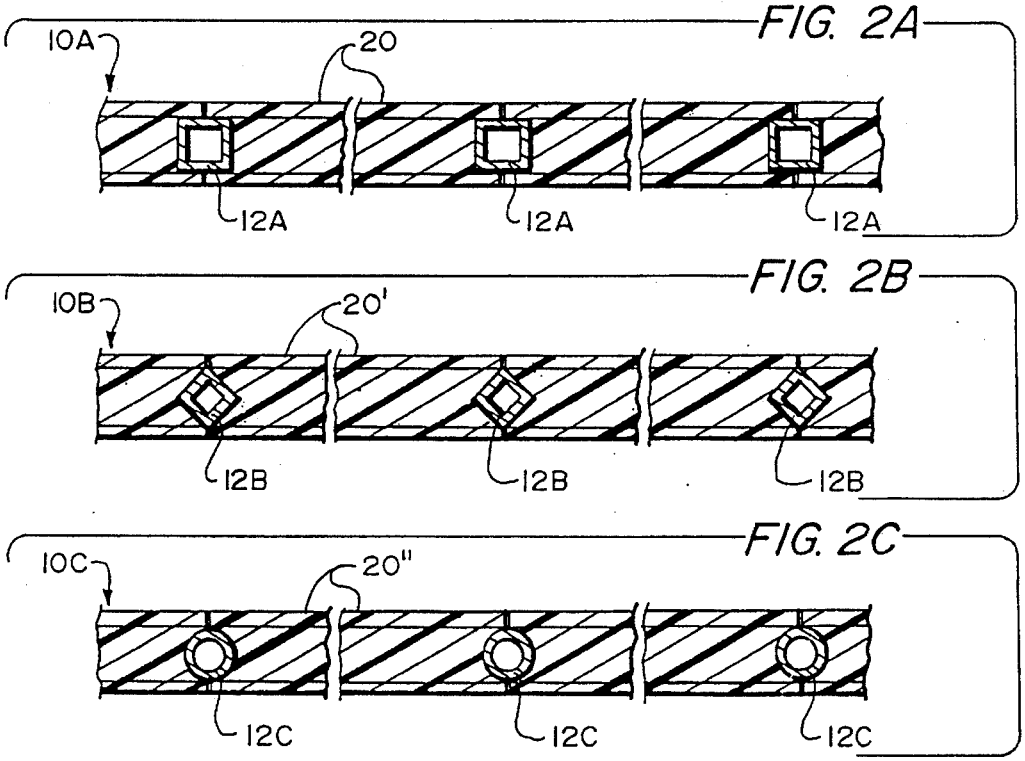
FIG. 2A
FIG. 2B
FIG. 2C

POST-AND-PANEL BUILDING WALLS

This is a continuation-in-part of my patent applications, Ser. Nos. 835,241 and 912,895 and 014,640, now U.S. Pat. No. 5,421,558, (respectively filed 12 February 1992, and 13 July 1992, and 8 February 1993), the first of which was a continuation-in-part of my prior application Ser. Nos. 178, 261 and 455,061, filed 6 April 1988 and 22 December 1992, and now U.S. Pat. Nos. 5,184,808 and 5,129,628, respectively—whose contents are incorporated into this application by these references.

TECHNICAL FIELD

This invention relates to post-and-panel fence and building walls with tubular upright posts fitting in hollowed vertical edges of panels preferably reinforced with end-to-end horizontal members.

BACKGROUND OF THE INVENTION

Fence walls of upright posts and reinforced lightweight panels have been disclosed by the present inventor as in the aforementioned patent applications, and have proved their merit in actual use. Contributions by other inventors to this field are identified in those patents, as in their specification or in the references cited during examination and prominently listed on their respective cover sheets.

The present invention discloses the utility of similar but distinct post-and-panel fence walls and building walls, external and/or internal, including load-bearing as well as non-load-bearing walls.

SUMMARY OF THE INVENTION

A primary object of the present invention is to extend proven post-and-panel fence wall technology to other post and panel walls.

Another object of this invention is to adapt post-and-panel construction to exterior and interior building walls.

A further object of the invention is to use tubular posts and lightweight reinforced panels in load-bearing building walls.

Yet another object of this invention is to provide reinforced insulating panels suitable for interior and exterior building walls.

A still further object of the invention is to accomplished the foregoing objects in an economical and simplified manner.

In general, the objects of the present invention are attained by providing in-line post-and-panel structures wherein upright posts support intervening panels by contact with vertical edges of the panels. The panels are thicker in the transverse direction than the posts, and the panels have their vertical side edges recessed to receive the in-line extent of adjacent posts therein over substantially the entire extent of the posts. The vertical edge recessing is sufficient to accommodate at least one-half of the in-line extent of the posts. Adjacent panels sandwich an intervening post, and the faces of the panels abut one another along substantially the entire extent of their vertical side edges.

More particularly, in plan the posts are tubular, and the vertical side edges of adjacent panels are recessed to accommodate the half circumferences of an intervening post. The panels are thicker transversely than the posts, so the edge recessing does not erupt to either face of the panels, and the abutting vertical edge portions of the adjacent panels are effective to conceal the intervening post from external view for substantially their entire vertical extent.

The panels advantageously have horizontal reinforcing members either embedded therein or extending along the panel bottom and/or top horizontal edges. The reinforcing members are fastened at their opposite ends to respective posts flanking a panel therebetween.

The posts are anchored at their bottom ends in subjacent supporting means, such as underground footings. The posts preferably also carry auxiliary supporting means extending a short distance horizontally therefrom to underlie and/or overlie and align with portions of adjacent panel horizontal top and bottom edges.

In a preferred embodiment, the panels have reinforcing channel members along the bottom horizontal edge and optionally along the top horizontal edge thereof. Auxiliary supporting means takes the form of a short upturned channel affixed at one end to the post to underlie an end portion of the panel bottom reinforcing channel.

Other objects of the present invention, together with means and methods for attaining the various objects, will become apparent from the following description and the accompanying diagrams of preferred embodiments presented here by way of example rather than limitation.

SUMMARY OF THE DRAWINGS

FIGS. 1A, 1B, and 1C are fragmentary side sectional elevations, partly sectioned away, of a fence wall, exterior building wall, and interior building wall, respectively, according to this invention;

FIGS. 2A, 2B, and 2C are plan views of various post-and-panel junctions suitable, respectively in fence walls, exterior building walls, and interior building walls according to this invention;

FIGS. 4A and 4B are respectively sequential plan views, similar to FIGS. 3A and 3D, of the bottom part of a reinforced panel and its assembly to a square post oriented diagonally instead of edge-on;

DESCRIPTION OF THE INVENTION

Figure 3A:
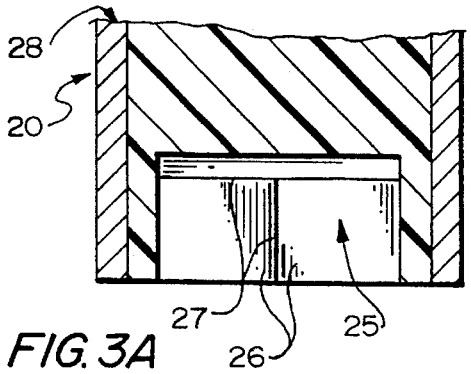
FIGS. 3A, 3B, 3C, and 3D comprise a sectional plan and an end elevation of a bottom end portion of a reinforced panel, and then an elevation and a sectional plan of its assembly to a square post.

FIG. 1A shows, in sectional elevation, fence wall 10A having an upright post 12A whose base portion is secured below ground level 15 in footing 13A (shaded for concrete). Pair of panels 20 abut one another along slit 19 between their adjacent vertical edges. At about ground level, stops 14 affixed to the post underlie and support bottom edge portions of the respective panels. Upper and lower reinforcing members 22 and 28 extend horizontally along the top and bottom edges of each panel and abut one another at the post, to which fasteners 24 secure the ends of the reinforcing members.

FIG. 1B shows, in sectional elevation, exterior building wall 10B, with upright post 12B based in sidewall footing 13B and sandwiched edgewise by pair of panels 20' with upper and lower horizontal reinforcing members 22 and 28 as before, except that there is no gap between the footing and the bottom of the panels and, thus, no stop underlying the lower reinforcing members. Roof 21 overlies and preferably rests on the panel top edges and their upper reinforcing members 22 and preferably ties to the top ends of peripheral posts.

FIG. 1C shows, also in sectional elevation, interior building partition wall 10C, with upright post 12C rising from floor footing 13C and through underfloor airspace about support 29 for flooring 9, upon top of which the bottom edges of pair of panels 20" rest along with their lower reinforcing members 28. Ceiling 23 overlies (well above) the illustrated shoulder-height partition panel top edges and the upper reinforcing members 22 of the panel, with bottom edges and reinforcing members 28 resting on the floor. As before, both reinforcing members are secured by fasteners 24 to post 12C, and stop 14 (dashed lines) may be used at floor level or be superseded by floor support.

FIG. 2A shows wall 10A in fragmentary plan view, partly broken away to conserve space while showing three posts 12A in-line, each spaced between a pair of panels 20 assembled thereto with vertical side edges of adjacent panels abutting one another at both faces of each. The posts are square in tubular cross-section, with two sides of each parallel, and two sides perpendicular, to the panel faces and fitting into complementary notch-like recesses in the abutting vertical panel edges. Such notch-like recess is twice as wide as it is deep, and does not erupt to either panel face so as to receive and conceal half of the peripheral extent of the post from outside.

FIG. 2B shows wall 10B in similar fragmentary plan view, partly broken away. Three posts 12A are in-line spaced between pairs of panels 20' assembled thereto with vertical side edges of adjacent panels abutting one another at both faces of each. The posts are square in tubular cross-section, with one diagonal of each parallel, and the other diagonal perpendicular, to the panel faces and fitting into complementary triangular recesses in the abutting panel edges.

FIG. 2C shows wall 10C similarly. Three posts 12A and four panels 20" are assembled in-line with vertical side edges of adjacent panels abutting one another at both faces of each. The posts are round in tubular cross-section. Semicylindrical recesses in the abutting vertical panel edges accommodate the posts, as the other shapes of notches received the diversely oriented square posts.

For consistency in representation, the fence post of FIG. 1A is shown with the square post in one orientation in FIG. 2A, and the exterior building wall utilizes a like post in diagonal orientation in FIG. 2B, and the interior wall of FIG. 1C has a round post in FIG. 2C, it will be understood that different shapes, sizes, and orientations of tubular posts may be used in any of the walls, notwithstanding that structural considerations, personal preference, cost, or availability may determine which wall contains which post.

Succeeding views illustrate how vertical side edges of the panels and the ends of the horizontal panel-reinforcing members are indented, in conjunction with indenting of the channel ends, to conform to a peripheral or circumferential one-half of a particular post/orientation arrangement, and eventually the reinforcing members are fastened to the posts.

FIG. 3A shows, in sectional plan, a bottom end portion of panel 20, with upturned channel-shaped reinforcing member 28. T-shaped slit 27 in the channel bed bisects the end for slightly more than one half the width of a square post and then extends toward opposite sides slightly more than an equal distance each way, outlining pair of potential tabs 26 that can be turned up as indicated here by a pair of diverging dashed arrows-and further in subsequent views. The foam of the panel is indented as notchlike recess 25 of a size to accommodate one-half of the extent of a square post (in plan).

Figure 3D:
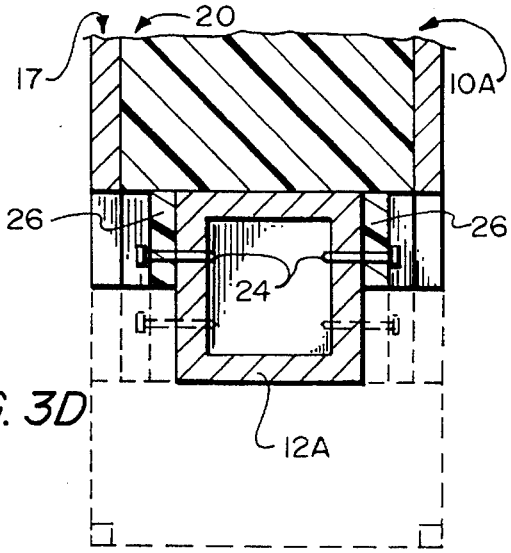
Figure 3B:
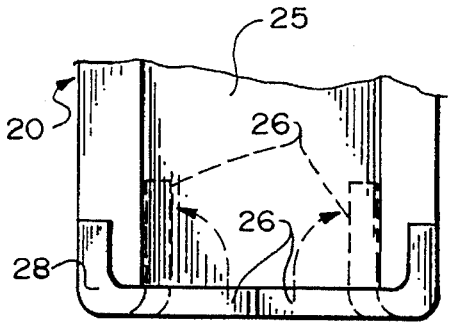

FIG. 3B is a side elevational view corresponding to the plan view of FIG. 3A and showing the lower part of a vertical side edge of panel 20 adapted to accommodate an upright post as shown later. Slit 26 bisects the bed of upturned channel-shaped reinforcing member 28. Dashed arrows indicate how the tabs formed by such slitting can be turned upward at the left and right, respectively, to abut the lowest portions of the sidewalls of recess 25 in the panel edge.

Figure 3C:
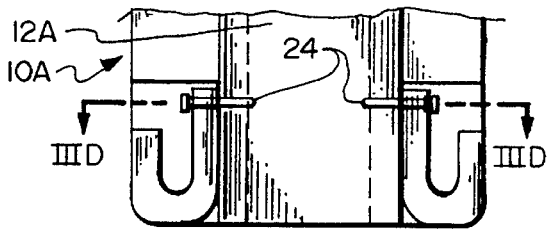

FIG. 3C shows in like elevation the same lower part of panel 20 as in FIG. 3A but with tabs 26 turned upward and with post 12A in place in the former recess with its bottom end between the upturned tabs. Fasteners 24 inserted from the outside through the respective tabs and through the adjacent sidewalls of the post secure the panel to the post, whose inside wall surface is shown in dashed lines.

FIG. 3D shows, in sectional plan taken at IIID—IIID in FIG. 3C, the appearance of panel 20 with post 12A in place between upturned tabs 26 and secured together by fasteners 24 as in fence 10A. Also indicated (dashed lines) in this view is an adjacent like panel as a mirror image of this one to illustrate how a post is sandwiched and concealed from the exterior by a pair of panels with their vertical side edges juxtaposed into abutment with one another.

Figure 4A:
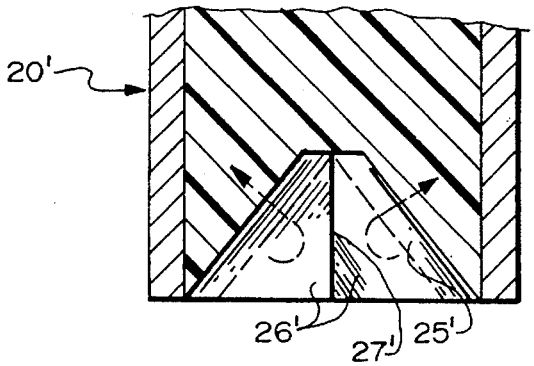
Figure 4B:
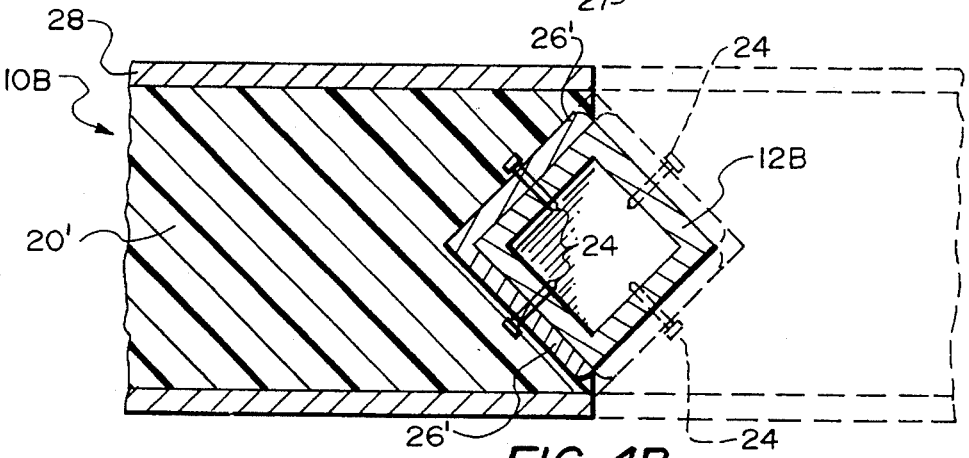

As indicated in FIG. 1B, a square post may be oriented with its diagonals directed as the sides of the edge-on post were in the FIG. 3A–D series of views. Such re-orientation necessitates different recessing and tabbing of the bottom end portion of the panel and its reinforcing member. FIGS. 4A and 4B illustrate such an embodiment, corresponding to FIGS. 3A and FIG. 3D of the previous embodiment.

FIG. 4A shows in plan panel 20' with same upturned reinforcing member 28 but with the panel edge indented by triangular recess 25'. Straight medial slit 27' extends from the outer edge to the apex of the triangular recess, forming two potential tabs 26' adapted to be swung upward as indicated here by a pair of diverging dashed arrows, and shown further in the next view.

FIG. 4B shows in plan, as in fence 10B, panel 20' with tabs 26' upturned against the sidewalls of post 12B, the same as the post in the last sequence of views except for its diagonal orientation here. It is also apparent that FIG. 4B is analogous to FIG. 3C, and the transition is accomplished without any need to show any equivalents of FIGS. 3B–C. Here again the panel is mirrored by a like aligned panel in dashed lines, the two panels together sandwiching the post between them and concealing it from the exterior.

Figure 5:
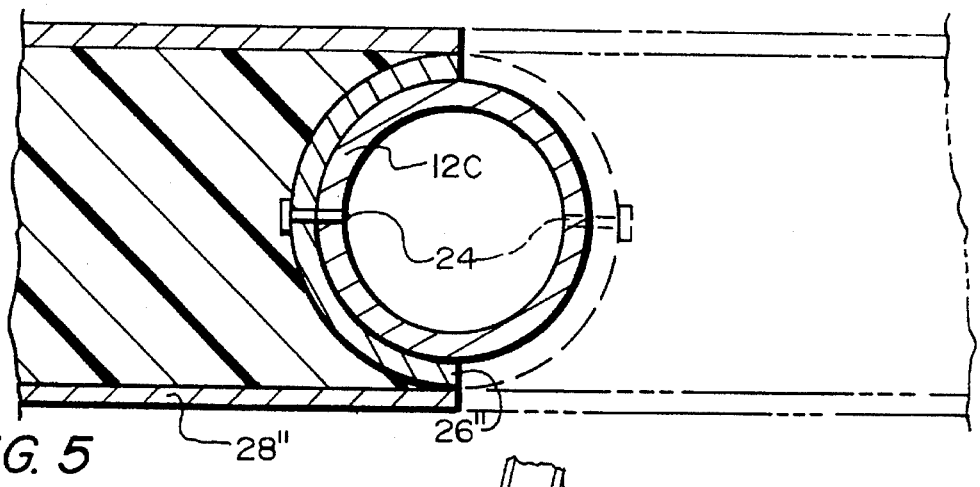
FIG. 5 is a plan view of an otherwise similar reinforced panel assembled to a round tubular post, in place of the square posts in previous views.

FIGS. 5 shows, in plan (similar to FIGS. 3D and 4B) wall 10C with round (instead of square) tubular post 12C assembled to wall panel 20"—plus an adjacent in-line panel suggested in dashed lines. The vertical side edges of panel 20" are indented by a semicylindrical recess to accommodate one-half of the circumferential extent of round post 12C. The end of the channel bed of bottom reinforcing member 28 is cut out semicircularly for the same purpose. As it would be awkward to cut out and upturn tabs from a semicircular edge, the end of the channel is swaged upward as semicircular lip 26". Fastener 24 is inserted through the swaged lip in like manner as through the tabs in the square post embodiments. In any version, inserted fasteners may be replaced by spot welding or the like.

Figure 6:
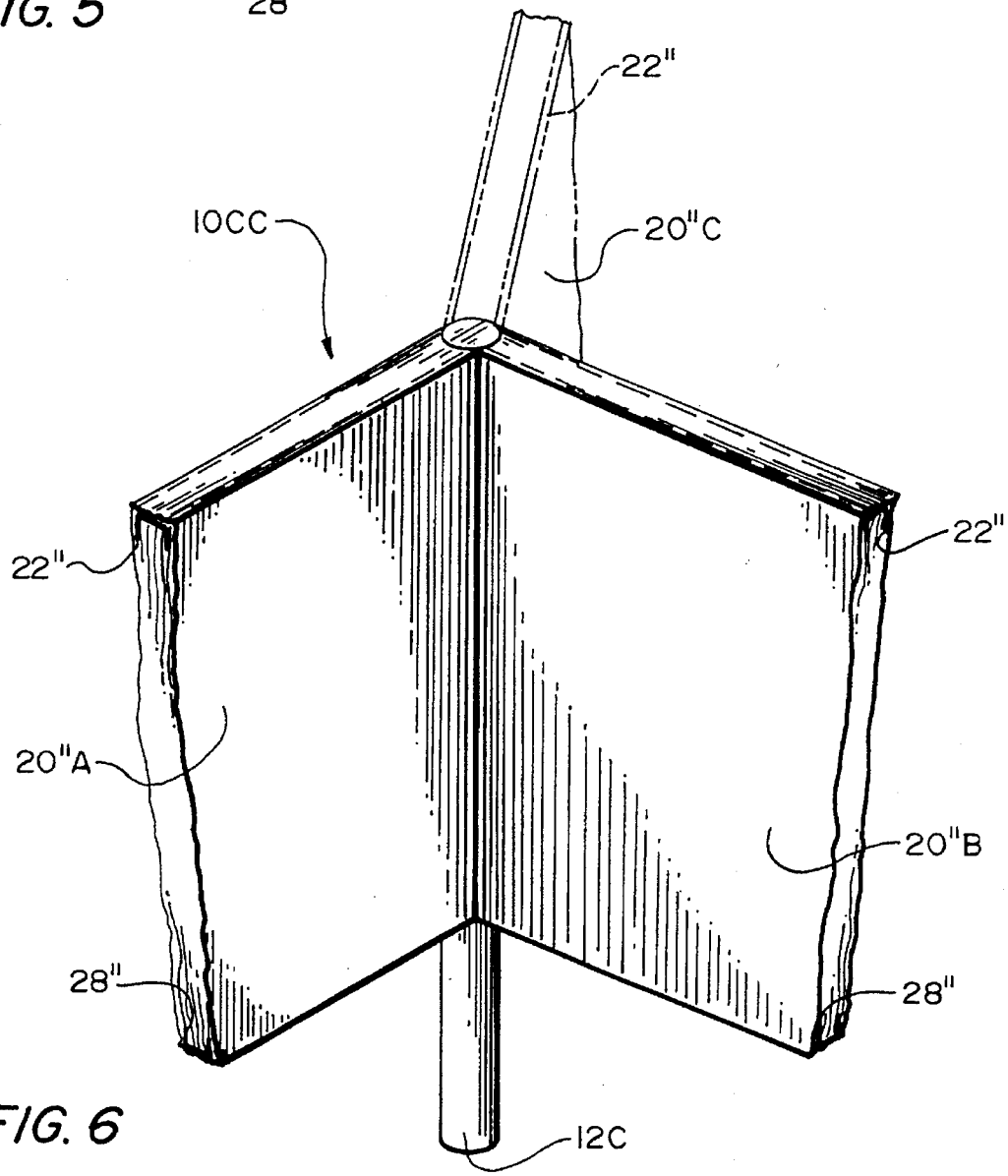
FIG. 6 is a perspective view of an assembly of reinforced panels assembled to a circular corner post according to this invention.

FIG. 6 shows, in perspective, multiple-corner wall structure 10C" with several panels 20"A, 20"B, and 20"C reinforced by upper and lower channel members 22" and 28" assembled to circular corner post 12C according to this invention. Round posts have an obvious advantage over square ones where walls meet at other than right angles. It will be understood that the abutting edges of the wall panels and their reinforcing members should be chamfered to fit (as shown) wherever they meet at less than a straight angle.

It also will be understood more generally that, if desired, each of the square and round posts may be provided with flanges adapted to extend into slotlike further indentations of the recesses in panel vertical side edges, for greater strength, security, or alignment assurance. Radial single-flange or parallel double-flange additions to the posts can be visualized as analogs of the I-beam post of the present inventor's patented fence walls. Of course, flanges tend to sacrifice the cost advantage of tubular posts.

Preferred embodiments and variants have been suggested for this invention. Other modifications may be made, as by adding, combining, deleting, or subdividing compositions, parts, or steps, while retaining all or some of the advantages and benefits of the present invention—which itself is defined in the following claims.

THE CLAIMED INVENTION:

1. A wall construction including tubular posts and intervening wall panels, the improvement comprising each of the wall panels comprising solid foam composition throughout with respective vertical side edges being recessed to receive substantially half of the respective adjacent tubular posts, at least one panel-reinforcing member extending the side-to-side distance between the vertical side edges of the wall panel, and end portions of the panel-reinforcing member being swaged into shape conforming to outlines of the tubular posts.

2. The improvement according to claim 1, with the respective end portions of the panel-reinforcing member swaged into post-conforming shape and abutting relationship to the posts adjoining the respective vertical side edges of the panels.

3. The improvement according to claim 2, with fastening means adapted to secure the respective post-conforming end portions of the panel-reinforcing member to the respective posts adjoining the vertical side edges of the panels.

4. The improvement according to claim 3, with the respective post-conforming end portions of the panel-reinforcing member secured to the respective posts by the fastening means.

5. Post-and-panel wall structure, comprising upright tubular posts arranged in-line spaced a panel length apart and anchored at their bottom ends, and in-line wall panels comprising solid foam composition intervening from post to post and having abutting vertical edges recessed to accommodate half the in-line extent of adjacent individual posts as viewed in plan, thereby concealing the posts between the level of the top edge to the level of the bottom edge of the abutting panels as viewed in elevation, each wall panel having at least one horizontal reinforcing member swaged at its ends to conform to the tubular post outline.

6. Wall structure according to claim 5, as a fence wall or exterior building wall wherein the post bottom ends are anchored in the subjacent ground.

7. Wall structure according to claim 5, wherein the panels include plural horizontal reinforcing members extending substantially the entire panel length between vertical side edges thereof and having post-conforming ends swaged to conform to the posts.

8. Wall structure according to claim 7, wherein the panels include as horizontal reinforcing members channel members extending substantially the entire panel length between vertical side edges thereof along both the top and the bottom edges of the panels and secured at their ends to the respective adjacent posts.

9. Wall structure according to claim 5, including fastener means adapted to secure the swaged ends of the horizontal reinforcing member to the respective adjacent posts.

10. Post-and-panel wall structure, comprising a plurality of upright tubular posts of given circumferential extent spaced a panel length apart and anchored at their bottom ends underlying floor level, and wall panels intervening from post to post and having abutting vertical edges recessed to accommodate part of the circumferential extent of adjacent individual posts as viewed in plan, and so to conceal the posts from the exterior between the level of the top edge to the level of the bottom edge of the edgewise abutting panels as viewed in elevation from the exterior, each panel including horizontal reinforcing channel members extending substantially the entire panel length between vertical side edges thereof along both the top and the bottom edges of the panels and being similarly recessed at their ends to accommodate a like part of the circumferential extent of a post and secured to the respective adjacent posts by Post-Conforming lips along the recessed ends, at least one post having at least several panels so secured.

11. Wall structure according to claim 10, wherein the post is circular in transverse cross-section.

12. Wall structure according to claim 10, wherein the post is anchored in masonry.

13. Wall structure according to claim 10, wherein the panel comprises solid foamed polymeric composition.

14. Post-and-panel wall structure, wherein each post has at least one wall panel abutting it, and each wall panel has at least one post abutting it, comprising a plurality of upright tubular posts circular in cross-section anchored at their bottom ends underlying a floor level, and a plurality of lightweight wall panels of polymeric foam, each panel individually having vertical side edges adapted to abut a post and suitably recessed to surround the abutted post to a limited preselected circumferential extent, each panel having at least one horizontal reinforcing member therein extending to said edges of the panel and shaped at its end to conform to the shape of the abutted post, fastening means securing together the abutted post and the shaped end of the reinforcing member, and the vertical side edges of the plurality of panels together abutting a given post and surrounding the post substantially entirely, and thereby concealing the post substantially entirely from side view between the top and bottom edges of the panels.

15. Wall structure according to claim 14, wherein at least one post has at least several panels abutting and concealing it.

16. Wall structure according to claim 14, wherein the end of the horizontal reinforcing member has a lip swaged to conform to the post shape, and the fastening means secures the lip to the abutting post.

* * * * *